United States Patent [19]

Abel et al.

[11] 4,453,946

[45] Jun. 12, 1984

[54] DYEING ASSISTANT AND USE THEREOF IN DYEING SYNTHETIC FIBRE MATERIAL

[75] Inventors: Heinz Abel, Reinach; Paul Schäfer, Riehen; Hans-Ulrich Berendt, Allschwil, all of Switzerland

[73] Assignee: Ciba-Geigy Corporation, Ardsley, N.Y.

[21] Appl. No.: 370,762

[22] Filed: Apr. 22, 1982

[30] Foreign Application Priority Data

Apr. 29, 1981 [CH] Switzerland ..... 2782/81

[51] Int. Cl.[3] ..... D06P 1/642; D06P 1/667

[52] U.S. Cl. ..... 8/603; 8/584

[58] Field of Search ..... 8/603, 584

[56] References Cited

U.S. PATENT DOCUMENTS

| | | | |
|---|---|---|---|
| 3,114,588 | 12/1963 | Lewis | 8/93 |
| 3,513,493 | 5/1970 | Chantilly et al. | 8/166 |
| 3,531,238 | 9/1970 | Hendricks et al. | 8/172 |
| 3,819,327 | 6/1974 | Kuwayama et al. | 8/172 |
| 3,957,430 | 5/1976 | Hewitt et al. | 8/172 |
| 4,072,465 | 2/1978 | Daeuble | 8/582 |

FOREIGN PATENT DOCUMENTS

| | | | |
|---|---|---|---|
| 1034782 | 7/1966 | United Kingdom | 252/174.15 |
| 1105595 | 3/1968 | United Kingdom . | |
| 1406803 | 9/1975 | United Kingdom . | |

*Primary Examiner*—Maria Parrish Tungol

*Attorney, Agent, or Firm*—Edward McC. Roberts

[57] ABSTRACT

The invention relates to a dyeing assistant comprising at least (A) an O-cyanoethylated compound of the formula $$R(O—CH_2CH_2CN)_n, \quad (1)$$

wherein R is an n-valent aliphatic, cycloaliphatic or araliphatic radical, and n is 1 to 5, (B) an anionic surfactant (C) a non-ionic surfactant and optionally at least one of the following components (D) an aliphatic alcohol containing 5 to 18 carbon atoms, a siloxane-oxyalkylene copolymer or a mixture thereof, and (E) a polar solvent.

This assistant is used in particular for dyeing synthetic fibre material, preferably polyester fibres, to improve levelness and crockfastness and to increase the dye yield.

23 Claims, No Drawings

DYEING ASSISTANT AND USE THEREOF IN DYEING SYNTHETIC FIBRE MATERIAL

The present invention relates to novel dyeing assistants and to the use thereof in dyeing synthetic fibre material, especially polyester fibres.

Levelling agents for synthetic fibre material often have the disadvantage that they retard the dye excessively and so inevitably cause a lowering of the dispersion stability when dyeing is complete and the dyebath cools. As the dyebath cools, the retarded dye, which is released by the usually non-ionic levelling agent, leads to recrystallisation, to deposits, and thus to unsatisfactory crockfastness of the dyeings. Although dispersing agents which are used specially for high temperature conditions are able to prevent such recrystallisation, they normally result in a diminution of colour yield and, in addition, they do not have any marked levelling effect.

Surprisingly, there has now been found a novel dyeing assistant which does not have the shortcomings referred to above. It ensures level penetration of the dye into the fibre material and, simultaneously, increased migration of the dye, resulting in an improvement in the levelness and crockfastness of the dyeings together with an increase in the colour yield.

Accordingly, the present invention provides a dyeing assistant which comprises at least (A) an O-cyanoethylated compound of the formula $$R(O-CH_2CH_2CN)_n \quad (1)$$

wherein R is an n-valent aliphatic, cycloaliphatic or araliphatic radical, and n is 1 to 5, (B) an anionic surfactant, and (C) a non-ionic surfactant.

Besides the above components (A), (B) and (C), the assistant composition may additionally contain (D) an aliphatic alcohol containing 5 to 18 carbon atoms, a siloxane-oxyalkylene copolymer, or a mixture thereof, and/or (E) a polar solvent.

Components (A), (B), (C), (D) and (E) may be in the form of individual compounds or mixtures. Preferred assistant compositions comprise all components (A), (B), (C), (D) and (E).

An aliphatic radical R is preferably the hydrocarbon radical of an unsaturated or preferably saturated aliphatic monoalcohol containing 3 to 24 carbon atoms. This hydrocarbon radical may be straight chain or branched. Examples of aliphatic saturated alcohols are: propanol, isopropanol, n-butanol, isobutanol, sec-butanol, tert-butanol, n-amyl alcohol, isoamyl alcohol, tert-amyl alcohol, neopentyl alcohol, hexanol, 2-methylpentanol, 2-ethyl-hexanol, trimethylhexanol, 5-methyl-heptan-3-ol, octan-2-ol, trimethyl nonyl alcohol, decanol, lauryl alcohol, myristyl alcohol, cetyl alcohol, heptadecyl alcohol, stearyl alcohol, arachidyl alcohol, behenyl alcohol or alfols. Some representatives of alfols are alfol (8–10), alfol (10–14) and alfol (16–18). Examples of unsaturated aliphatic alcohols are: allyl alcohol, butenol, dodecenyl alcohol, hexadecenyl alcohol or oleyl alcohol. The alcohol radicals may be present individually or as mixtures, and may be mono-, di- or triethoxylated.

An aliphatic radical R may also be derived from a monohydric aliphatic alcohol which contains at least 2, preferably 2 to 5, hydroxyl groups and preferably 2 to 9 carbon atoms, e.g. from an alkylenediol having an alkylene radical of 2 to 6 carbon atoms, such as ethylene glycol, 1,3- or 1,2-propylene glycol or 1,5-pentanediol, as well as glycerol, trimethylolethane, trimethylolpropane, erythritol, pentaerythritol, mannitol or sorbitol. These polyhydric alcohols can also be etherified with 1 to 6 moles of ethylene oxide or propylene oxide or mixtures thereof.

An aliphatic radical R is preferably alkenyl or, most preferably, alkyl, each of 3 to 22 carbon atoms.

A cycloaliphatic or araliphatic radical R is preferably derived from cyclopentanol, cyclohexanol, cyclododecanol, p-nonylcyclohexanol, hydroabietyl alcohol, benzyl alcohol, phenylethyl alcohol or phenoxyethanol, and the benzene nucleus may also be substituted by lower alkyl, e.g. methyl, ethyl or isopropyl, or by lower alkoxy such as methoxy, ethoxy or isopropoxy, or by halogen.

Very suitable cyanoethylated compounds have the formula $$R_1-O-CH_2CH_2CN \quad (2)$$

wherein $R_1$ is an aliphatic radical of 3 to 22 carbon atoms or a phenoxyethyl radical which is unsubstituted or substituted by halogen, lower alkyl or lower alkoxy.

Lower alkyl and lower alkoxy in the definition of the radicals of the cyanoethylated compounds are usually those groups or group components which contain 1 to 5, preferably 1 to 3, carbon atoms, e.g. methyl, ethyl, n-propyl, isopropyl, n-butyl, sec-butyl or amyl, or methoxy, ethoxy or isopropoxy.

Halogen in connection with all substituents is e.g. fluorine, bromine or, preferably, chlorine.

Typical representatives of the cyanoethylated compounds employed in this invention are those of the formulae:

(3) $C_2H_5-OCH_2CH_2CN$ (4) $C_4H_9O-CH_2CH_2CN$ (5) $(CH_3)_2CH-CH_2O-CH_2CH_2CN$ (6) $CH_3CH_2CH_2\underset{\underset{CH_3}{|}}{CH}-CH_2-O-CH_2CH_2CN$ (7) $C_6H_{13}O-CH_2CH_2CN$ (8) $C_6H_{13}-\underset{\underset{CH_3}{|}}{CH}-O-CH_2CH_2CN$ (9) $C_8H_{17}O-CH_2CH_2CN$

(10) $C_4H_9\underset{\underset{C_2H_5}{|}}{CH}-CH_2O-CH_2CH_2CN$

(11) $CH_3CH_2-\underset{\underset{CH_3}{|}}{CH}CH_2\underset{\underset{C_2H_5}{|}}{CH}-OCH_2CH_2CN$

(12) $C_{12}H_{25}O-CH_2CH_2CN$

(13) $(CH_3)_3C-CH_2O-CH_2CH_2CN$

(14) $(CH_3)_3C-CH_2\underset{\underset{CH_3}{|}}{CH}CH_2CH_2O-CH_2CH_2CN$

(15) $R'-O-CH_2CH_2CN$

-continued

(16) $C_{18}H_{37}O-CH_2CH_2CN$

(17) $NC-CH_2-CH_2-O-CH_2CH_2-O-CH_2CH_2CN$

(18) $NC-CH_2CH_2-O-CH_2CH_2-S-CH_2CH_2CN$ (19)

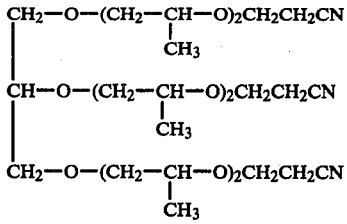

(20)

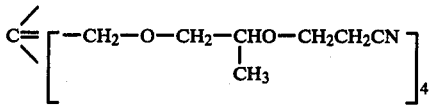

(21)

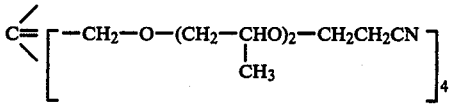

(22)

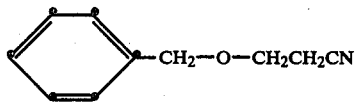

(23)

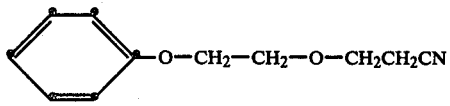

(24)

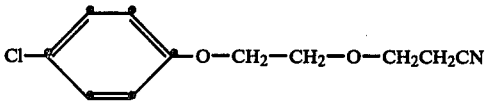

(25)

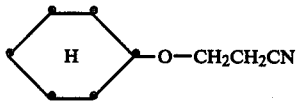

R' = alfol radical (8–10), (10–14), (12–14) (12–18) or (16–18)

Among these representatives, especially preferred compounds are those of the formulae (8), (11), (12), (13), (14) and (23).

The compounds of the formulae (1) to (25) are prepared in a manner which is known per se. The preferred procedure is to react an alcohol of the formula R—OH, wherein R has the given meaning, with acrylonitrile. The reaction is conveniently carried out in an aqueous medium, e.g. in alcoholic medium, in the presence of an alkali metal hydroxide or alkali metal alcoholate or of a quaternary base such as trimethylbenzyl ammonium hydroxide, and in the temperature range from 10° to 60° C.

The anionic surfactants (B) are preferably derivatives of alkylene oxide adducts, e.g. adducts of alkylene oxides, preferably of ethylene oxide and/or propylene oxide or also styrene oxide, with organic hydroxyl, carboxyl, amino and/or amido compounds containing aliphatic hydrocarbon radicals having a total of at least 4 carbon atoms, or mixtures of such compounds, which adducts contain acid ether groups or, preferably, acid ester groups of inorganic or organic acids. These acid ethers or esters can be in the form of the free acids or salts, e.g. alkali metal salts, alkaline earth metal salts, ammonium or amine salts.

These anionic surfactants are obtained by known methods, by addition of at least 1 mole, preferably of more than 1 mole, e.g. 2 to 60 moles, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Examples of suitable anionic surfactants are:

sulfated aliphatic alcohols which contain 8 to 18 carbon atoms in the alkyl chain, e.g. sulfated lauryl alcohol;

sulfated unsaturated fatty acids or fatty acid lower alkyl esters which contain 8 to 20 carbon atoms in the fatty radical, e.g. ricinic acid and oils containing such fatty acids, e.g. castor oil;

alkylsulfonates containing 8 to 20 carbon atoms in the alkyl chain, e.g. dodecylsulfonate;

alkylarylsulfonates with linear or branched alkyl chain containing at least 6 carbon atoms, e.g. dodecylbenzenesulfonates or 3,7-diisobutylnaphthalenesulfonates;

sulfonates of polycarboxylic acid esters, e.g. dioctylsulfosuccinates or sulfosuccinamides;

the alkali metal salts, ammonium salts or amine salts of fatty acids containing 10 to 20 carbon atoms, e.g. rosin salts, classified as soaps;

esters of polyalcohols, especially mono- or diglycerides of fatty acids containing 12 to 18 carbon atoms, e.g. monoglycerides of lauric, stearic or oleic acid; and the adducts of 1 to 60 moles of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alkanols containing 3 to 6 carbon atoms, which adducts are converted into an acid ester with an organic dicarboxylic acid, e.g. maleic acid or sulfosuccinic acid, but preferably with an inorganic polybasic acid such as o-phosphoric acid or sulfuric acid.

Very suitable anionic surfactants (B) are acid esters, or acid ester salts, of a polyadduct of 2 to 50 moles of ethylene oxide with 1 mole of a fatty alcohol containing 8 to 22 carbon atoms, or with 1 mole of a phenol which contains at least one benzyl group, one phenyl group or preferably one alkyl group containing at least 4 carbon atoms, e.g. benzylphenol, dibenzylphenol, dibenzyl(nonyl)phenol, o-phenylphenol, butylphenol, tributylphenol, octylphenol, nonylphenol, dodecylphenol or pentadecylphenol, which acid esters may be used individually or in admixture.

Preferred components (B) have the formula $$Y—O—(CH_2CH_2O)_mX, \quad (26)$$

wherein Y is alkyl or alkenyl, each of 8 to 22 carbon atoms, alkylphenyl containing 4 to 16 carbon atoms in the alkyl moiety, or o-phenylphenyl, X is the acid radical of an inorganic oxygen-containing acid, e.g. sulfuric acid or, preferably, phosphoric acid, or is also the radical of an organic acid, and m is 2 to 40, preferably 2 to 15. The alkyl moiety of alkylphenyl is preferably in the para-position, and can be butyl, hexyl, n-octyl, n-nonyl, p-tert-octyl, p-isononyl, decyl or dodecyl. Preferred alkyl radicals are those containing 8 to 12 carbon atoms, with octyl and nonyl being most preferred.

The fatty alcohols for obtaining the anionic surfactants of the formula (26) are e.g. those containing 8 to 22, preferably 8 to 18, carbon atoms, such as octyl, decyl, lauryl, tridecyl, myristyl, cetyl, stearyl, oleyl, arachidyl or behenyl alcohol.

The acid radical X is derived, for example, from a low molecular dicarboxylic acid, e.g. from maleic acid, succinic acid or sulfosuccinic acid, and is linked to the oxyethylene part of the molecule through an ester bridge. In particular, X is derived from an inorganic polybasic acid such as sulfuric acid and, in particular, orthophosphoric acid. The acid radical X can be in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Particularly preferred components (B) are anionic surfactants of the formula

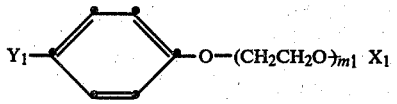

(27)

wherein $Y_1$ is octyl or nonyl, $m_1$ is 2 to 15, and $X_1$ is a radical derived from sulfuric acid or, preferably from o-phosphoric acid, which surfactants are in the form of free acids or sodium or ammonium salts. A particularly preferred anionic surfactant is the acid phosphoric acid ester of the adduct of 5 to 12 moles of ethylene oxide with 1 mole of p-nonylphenol.

The anionic surfactants (B) may be used by themselves or as mixtures with one another.

The non-ionic surfactant (C) is advantageously a non-ionic adduct of 1 to 100 moles of alkylene oxide, e.g. ethylene oxide and/or propylene oxide, and 1 mole of an aliphatic monoalcohol containing at least 4 carbon atoms, of a trihydric to hexahydric aliphatic alcohol, of an unsubstituted or alkyl- or phenyl-substituted phenol, or of a fatty acid containing 8 to 22 carbon atoms.

The aliphatic monoalcohols employed for obtaining the non-ionic surfactants are e.g. water-insoluble monoalcohols containing at least 4, preferably 8 to 22, carbon atoms. These alcohols may be saturated or unsaturated and branched or straight-chain, and they may be employed individually or in admixture. It is possible to react natural alcohols, e.g. myristyl alcohol, cetyl alcohol, stearyl alcohol or oleyl alcohol, or synthetic alcohols, e.g. oxo alcohols such as, in particular, 2-ethylhexanol, and also trimethylhexanol, trimethylnonyl alcohol, hexadecyl alcohol or alfols, with the alkylene oxide.

Further aliphatic alcohols which can be reacted with alkylene oxide are trihydric to hexahydric alkanols. These contain 3 to 6 carbon atoms and are, in particular, glycerol, trimethylolpropane, erythritol, mannitol, pentaerythritol and sorbitol. The trihydric to hexahydric alcohols are preferably reacted with propylene oxide or ethylene oxide or with mixtures thereof.

Examples of suitable unsubstituted or substituted phenols are phenol, o-phenylphenol or alkylphenols containing 1 to 16, preferably 4 to 12, carbon atoms, in the alkyl moiety. Examples of these alkylphenols are: p-cresol, butylphenol, tributylphenol, octylphenol and, in particular, nonylphenol.

The fatty acids contain preferably 8 to 12 carbon atoms and may be saturated or unsaturated, e.g. capric, lauric, myristic, palmitic or stearic acid, and decenoic, dodecenoic, tetradecenoic, hexadecenoic, oleic, linoleic, linolenic or, preferably, ricinolic acid.

Representative examples of non-ionic surfactants are:

polyadducts of preferably 1 to 30 moles of alkylene oxides, especially ethylene oxide, individual ethylene oxide units of which can be replaced by substituted epoxides such as styrene oxide and/or propylene oxide, with higher unsaturated or saturated fatty alcohols, fatty acids, fatty amines or fatty amides containing 8 to 22 carbon atoms, or with phenylphenol or alkylphenols, the alkyl moieties of which contain at least 4 carbon atoms;

alkylene oxide condensation products, especially ethylene oxide and/or propylene oxide condensation products;

reaction products of a fatty acid containing 8 to 22 carbon atoms and a primary or secondary amine which contains at least one hydroxy-lower alkyl or lower alkoxy-lower alkyl group, or adducts of these hydroxyalkylated reaction products with alkylene oxide, the reaction being conducted such that the molecular ratio of hydroxyalkylamine to fatty acid can be 1:1 and greater than 1, e.g. 1.1:1 to 2:1; and polyadducts of propylene oxide with a trihydric to hexahydric aliphatic alcohol containing 3 to 6 carbon atoms, e.g. glycerol or pentaerythritol, said polypropylene oxide adducts having an average molecular weight of 250 to 1800, preferably 400 to 900.

Very suitable non-ionic surfactants are polyadducts of 2 to 15 moles of ethylene oxide and 1 mole of a fatty alcohol or fatty acid, each containing 8 to 22 carbon atoms, or 1 mole of an alkylphenol containing a total of 4 to 12 carbon atoms in the alkyl moiety; or are fatty acid dialkanolamides containing 8 to 22 carbon atoms in the fatty acid moiety.

Preferred assistants comprise at least the following components:

(Aa) an O-cyanoethylated compound of the formula $$R_2—O—CH_2CH_2CN \quad (28)$$

wherein $R_2$ is an aliphatic radical of 6 to 22 carbon atoms or a phenoxyethyl radical which is unsubstituted or substituted by halogen, methyl or methoxy, (Bb) an acid ester, preferably a phosphoric acid ester, or a salt of such an ester, of a polyadduct of 2 to 20 moles of ethylene oxide with 1 mole of a fatty alcohol containing 8 to 18 carbon atoms, or with 1 mole of a p-alkylphenol containing 4 to 16 carbon atoms in the alkyl moiety, or a mixture of these acid esters, and (Cc) an adduct of 2 to 15 moles of ethylene oxide with 1 mole of a fatty alcohol or fatty acid, each containing 8 to 22 carbon atoms, or preferably with 1 mole of an alkylphenol containing altogether 4 to 12 carbon atoms in the alkyl moiety.

In addition to containing components (A), (B) and (C), the novel dyeing assistant may also contain, as component (D), an aliphatic alcohol containing 5 to 18 carbon atoms or a siloxane-oxyalkylene copolymer, or preferably a mixture of such compounds. Component (D) acts in particular as foam inhibitor.

The alcohols may be used as individual compounds or in admixture with one another. They may be straight chain or branched, saturated or unsaturated, and they will normally be liquid at room temperature. Typical examples of such alcohols are: n-amyl alcohol, n-hexanol, trimethylhexanol, 2-ethyl-n-hexanol, octyl alcohol (octanol mixture of isomers), nonyl alcohol, decyl alcohol, lauryl alcohol, tridecyl alcohol, myristyl alcohol, cetyl alcohol, stearyl alcohol or oleyl alcohol, and also the alfols, e.g. alfol (6–10), alfol (8–10), alfol (10–14), alfol (12), alfol (16) and alfol (18). Preferred alcohols are alkanols of 5 to 10 carbon atoms, with 2-ethyl-n-hexanol being particularly preferred.

Further suitable optional components (D) are commercially available hydrophilic adducts of an organopolysiloxane and ethylene oxide and/or propylene oxide.

The organopolysiloxanes employed as starting materials for obtaining such adducts are, in principle, commercially available silicone oils which are described in German Auslegeschrift No. 20 31 827. Among these silicone oils, polydimethylsiloxanes are preferred. The siloxane-oxyalkylene copolymers suitable for use as optional component (D) may be obtained e.g. from halogen-substituted organopolysiloxanes, in particular polydimethylsiloxanes and alkali metal salts of polyoxyalkylene, e.g. polyethylene and/or propypropylene glycols.

The siloxane-oxyalkylene copolymers used as component (C) are polyether siloxanes which advantageously have a cloud point in the range from about 20°–70° C., preferably from 25°–50° C. The glycol content consisting of oxyethylene groups or oxyethylene and oxypropylene groups is advantageously from 35 to 85% by weight, preferably from 40 to 75% by weight, based on the total weight of the polyether siloxane.

A preferred embodiment of the optional component (D) is accordingly a block polymer of a polydimethyl siloxane and ethylene oxide, or of a copolymer of ethylene oxide and propylene oxide, which block polymer has a cloud point of 20°–70° C., preferably from 25°–50° C. Such block polymers or polyether siloxanes may be illustrated by the probable formula

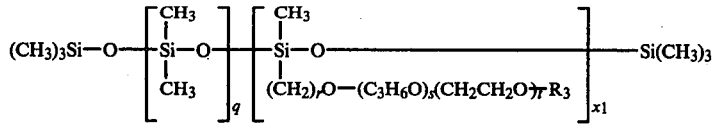

(29)

wherein q is 3 to 50, preferably 3 to 25, r is 2 or 3, s is 0 to 15, t is 1 to 25, $x_1$ is 3 to 10 and $R_3$ is alkyl of 1 to 4 carbon atoms, preferably methyl. Such polyether siloxanes are described e.g. in German Auslegeschrift No. 1 719 328 and in U.S. Pat. Nos. 2,834,748, 3,389,160 and 3,505,377.

Further polyether siloxanes which may be used as component (D) have the probable formula

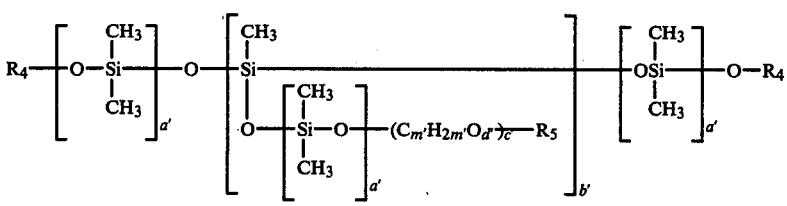

(30)

wherein each of $R_4$ and $R_5$ is alkyl of 1 to 4 carbon atoms, preferably methyl, a' is 1 to 20, b' is 2 to 20, c' is 2 to 50, d' is 1 or 2, preferably 1, and m' is 2 to 5, and the groups $C_{m'}H_{2m'}O_{d'}$ are preferably ethylene oxide groups or mixtures of ethylene oxide groups and propylene oxide groups. Such siloxane compounds are described in German Auslegeschrift No. 1 795 557.

A suitable optional component (D) which corresponds to the probable formula (29) and has a cloud point of 32° C., is e.g. SILICONSURFACTANT L 546® (registered trademark of Union Carbide). This silicone compound is used preferably in conjunction with 2-ethyl-hexanol.

In addition, the assistants of this invention may contain, as polar solvent (E), a water-miscible organic solvent. The addition of solvent improves the solubility of the composition. Examples of water-miscible organic solvents are aliphatic $C_1$–$C_4$alcohols such as methanol, ethanol, the propanols or isobutanol; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone, methyl ethyl ketone, cyclohexanone or diacetone alcohol; ethers and acetals such as diisopropyl ether, diphenyl oxide dioxane, tetrahydrofurane, and also tetrahydrofurfuryl alcohol, pyridine, acetonitrile, γ-butyrolactone, N-methylpyrrolidone, N,N-dimethyl formamide, N,N-dimethyl acetamide, tetramethyl urea, tetramethylene sulfone etc. Mixtures of these solvents may also be used. The preferred solvents are water and isobutanol.

The assistant compositions of this invention advantageously contain 10 to 80% by weight of component (A),
10 to 50% by weight of component (B),
5 to 25% by weight of component (C), 0 to 15% by weight, preferably 2 to 10% by weight, of component (D), and 0 to 40% by weight, preferably 10 to 35% by weight, of component (E), in each case based on the weight of the total mixture.

The novel dyeing assistant compositions may be prepared by simple stirring of components (A), (B), (C) and optionally (D) and/or (E), to produce homogeneous clear formulations which are stable at room temperature.

The novel formulations are used in particular as levelling agents in dyeing synthetic fibre material. They increase the rate of diffusion of the dyes in the fibres and thereby accelerate migration of the dyes in dyeing synthetic fibre material, preferably linear polyester fibres.

Accordingly, the present invention also provides a process for dyeing synthetic fibre material with cationic or disperse dyes, or for whitening such material with fluorescent whitening agents, which process comprises dyeing or whitening said material in the presence of the dyeing assistant of the invention. Disperse dyes are preferred.

The amount in which the dyeing assistant of the invention is added to the dyebaths varies from 0.5 to 6% by weight, preferably from 2 to 4% by weight, based on the weight of the material to be dyed.

Suitable fibre material, in particular textile material, which can be dyed or whitened in the presence of the dyeing assistant composition of the present invention is e.g. material made from cellulose esters, such as cellulose 2½-acetate and cellulose triacetate fibres, from synthetic polyamide fibres, e.g. from ε-caprolactam, from adipic acid and hexamethylenediamine, and from ω-aminoundecanoic acid; aromatic polyamide fibres which are derived e.g. from poly-(metaphenyleneisophthalamide), polyacrylonitrile fibres, including modacryl fibres, acid modified polyester fibres and, in particular, linear polyester fibres. Cellulose ester, polyamide and polyester fibres are preferably dyed with disperse dyes, and polyacrylonitrile fibres, acid modified polyester fibres and aromatic polyamide fibres are preferably dyes with cationic dyes.

Linear polyester fibres are to be construed as meaning synthetic fibres which are obtained e.g. by condensation of terephthalic acid with ethylene glycol or of isophthalic acid or terephthalic acid with 1,4-bis-(hydroxymethyl)cyclohexane, as well as copolymers of terephthalic acid and isophthalic acid and ethylene glycol. The linear polyester used up to now almost exclusively in the textile industry is that derived from terephthalic acid and ethylene glycol. To the acrylic fibres which can be dyed by the process of the invention belong the commercially available types of polymers and copolymers of acrylonitrile. The content of acrylonitrile in acrylonitrile copolymers is advantageously at least 80% by weight, based on the weight of the copolymer. Acid modified polyester fibres are e.g. polycondensates of terephthalic acid or isophthalic acid, ethylene glycol and 1,2- or 1,3-dihydroxy-3-(3-sodium sulfopropoxy)propane, 2,3-dimethylol-1-(sodium sulfopropoxy)butane, 2,2-bis-(3-sodium sulfopropoxyphenyl)propane or 3,5-dicarboxybenzenesulfonic acid or sulfonated terephthalic acid, sulfonated 4-methoxybenzenecarboxylic acid or sulfonated diphenyl-4,4'-dicarboxylic acid.

The fibre materials can also be employed as blends with another or with orther fibres, e.g. blends of polyacrylonitrile/polyester, polyamide/polyester, polyester/cotton, polyester/viscose and polyester/wool.

The textile material to be dyed or whitened can be in different states of processing, for example loose material, piece goods, such as knits or wovens, and yarn in wound or muff form. These last mentioned materials may have a compactness of 200 to 600 g/dm$^3$, preferably of 400 to 450 g/dm$^3$.

Cationic dyes suitable for the process of the invention may belong to various classes of dye. In particular, they comprise the customary salts, for example chlorides, sulfates or metal halides, for example zinc chloride double salts, of cationic dyes whose cationic character derives for example from a carbonium, oxonium, sulfonium or, above all, ammonium group. Examples of such chromophoric systems are azo dyes, primarily monoazo or hydrazone dyes, diphenylmethane, triphenylmethane, methine or azomethine dyes, coumarin, ketoneimine, cyanine, xanthene, azine, oxazine or thiazine dyes. Finally, it is also possible to use dye salts of the phthalocyanine or anthraquinone series with an external onium group, for example an alkylammonium or cycloammonium group and also benzo-1,2-pyrane dye salts which contain cycloammonium groups.

The disperse dyes to be used, which are soluble in water to only a very limited degree and are present in the dye liquor for the most part in the form of a fine dispersion, may belong to the most diverse dyestuff classes, for example to the acridone, azo, anthraquinone, coumarin, methine, perinone, naphthoquinoneimine, quinophthalone, styryl or nitro dyes.

Mixtures of cationic or disperse dyes may also be used in the process of the invention.

The novel assistant compositions may also be used in the whitening of undyed synthetic fibre materials with fluorescent whitening agents which are dispersed in water or with cationic fluorescent whitening agents. For this utility, the treatment of polyester fibre material with fluorescent whitening agents which are dispersed in water is preferred.

The fluorescent whitening agents may belong to any class of such compounds. In particular they are coumarins, triazole coumarins, benzocoumarins, oxazines, pyrazines, pyrazolines, diphenyl pyrazolines, stilbenes, styryl stilbenes, triazolyl stilbenes, bisbenzoxazolyl ethylenes, stilbene bis-benzoxazoles, phenylstilbene oxazoles, thiophene bis-benzoxazoles, naphthalene bis-benzoxazoles, benzofuranes, benzimidazoles and naphthalimides.

Mixtures of fluorescent whitening agents may also be used in the practice of this invention.

The amount of dye or fluorescent whitening agent to be added to the liquor depends on the desired colour strength. In general, amounts of 0.01 to 10% by weight, preferably 0.02 to 5% by weight, based on the weight of the textile material employed, have proved advantageous.

The assistants to be employed in the practice of this invention may also be used in admixture with known carriers based on e.g. di- or trichlorobenzene, methyl or ethyl benzene, o-phenylphenol, benzylphenol, diphenyl ether, chlorodiphenyl, methyl diphenyl, cyclohexanone, acetophenone, alkylphenoxy ethanol, mono-, di- or trichlorophenoxy ethanol or mono-, di- or trichlorophenoxy propanol, pentachlorophenoxy ethanol, alkylphenylbenzoates or, in particular, based on diphenyl, methyl diphenyl ether, dibenzyl ether, methyl benzoate, butyl benzoate or phenyl benzoate.

The carriers are used preferably in an amount of 0.5 g/l to 2 g/l of liquor or 5 to 30% by weight, based on the assistant composition.

Depending on the textile material to be treated, and dyebaths or whitening baths may contain, in addition to the dyes or fluorescent whitening agents and assistants of the invention, also oligomer inhibitors, antifoams, anticrease agents, retarders and, preferably, dispersants.

The purpose of the dispersants is in particular to obtain a good dispersion of the dipserse dyes. Suitable dispersants are those customarily employed in dyeing with disperse dyes. Preferred dispersants are sulfated or phosphated adducts of 15 to 100 moles of ethylene oxide or preferably propylene oxide with polyhydric aliphatic alcohols containing 2 to 6 carbon atoms, e.g. ethylene glycol, glycerol or pentaerythritol, or with amines containing 2 to 9 carbon atoms and at least two amino groups or one amino group and one hydroxyl group, as well as alkylsulfonates containing 10 to 20 carbon atoms in the alkyl chain, alkylbenzenesulfonates with straight or branched alkyl chain containing 8 to 20 carbon atoms, e.g. nonyl- or dodecylbenzenesulfonate, 1,3,5,7-tetramethyloctylbenzenesulfonate or octadecylbenzenesulfonate, and alkylnaphthalenesulfonates or sulfosuccinates, such as sodium dioctylsulfosuccinate.

Particularly suitable anionic dispersants are lignosulfonates, polyphosphates and, preferably, formaldehyde condensation products of aromatic sulfonic acids, formaldehyde and, optionally, of mono- or bifunctional phenols, e.g. of cresol, β-naphtholsulfonic acid and formaldehyde, of benzenesulfonic acid, formaldehyde and naphthalenesulfonic acid, of naphthalenesulfonic acid and formaldehyde, or of naphthalenesulfonic acid, dihydroxydiphenylsulfone and formaldehyde. The preferred anionic dispersant is the disodium salt of di-(6-sulfonaphthyl-2)-methane.

Mixtures of anionic dispersants may also be employed. Normally the anionic dispersants will be in the form of their alkali metal salts, ammonium salts or amine salts. These dispersants are preferably employed in an amount of 0.1 to 5 g/l of treatment liquor.

The dyebaths or whitening baths may also contain conventional additives, advantageously electrolytes such as salts, e.g. sodium sulfate, ammonium sulfate, sodium or ammonium phosphates or sodium or ammonium polyphosphates, metal chlorides or metal nitrates such as calcium chloride, magnesium chloride or calcium nitrates, ammonium acetate or sodium acetate and/or acids, e.g. mineral acids, such as sulfuric acid or phosphoric acid, or organic acids, preferably lower aliphatic carboxylic acids, such as formic acid, acetic acid or oxalic acid. The acids are used in particular for adjusting the pH value of the dyebaths employed in the invention. The pH value is ordinarily in the range from 4 to 6.5, preferably from 4.5 to 6.

Dyeing or whitening is performed advantageously from an aqueous liquor by the exhaust method. The liquor ratio can accordingly be chosen within a wide range, e.g. from 1:3 to 1:100, preferably from 1:7 to 1:50. The dyeing or whitening temperature is at least 70° C. and is ordinarily not higher than 140° C. Preferably it is in the range from 80° to 135° C.

Linear polyester fibres and cellulose triacetate fibres are preferably dyed by the high temperature process is closed and advantageously also pressure-resistant machines at temperatures above 100° C., preferably in the range between 110° and 135° C., and optionally under pressure. Examples of suitable closed dyeing machines are circulating liquor machines such as cheese dyeing and beam dyeing machines, winch becks, jet dyeing or rotary dyeing machines, muff dyeing machines, paddles or jiggers.

Cellulose 2½-acetate fibres are preferably dyed at temperatures from 80° to 85° C., whilst polyamide and polyacrylonitrile fibres are dyed with advantage at the boiling point of the aqueous bath (98° C.). Aromatic polyamide fibres or acid modified polyester fibres are preferably dyed in the temperature range from 80° to 130° C.

The dyeing process of the present invention can be carried out such that the material to be dyed is either briefly treated first with the dyeing assistant and then dyed, or preferably simultaneously with the assistant and the dye. The goods are preferably run for 5 minutes at 60°–80° C. in the bath which contains the dye, the assistant composition and optionally further ingredients, and which is adjusted to a pH value of 4.5 to 5.5, then the temperature is raised over 15 to 35 minutes to 110°–135° C., preferably to 130° C., and the bath is left for 15 to 90 minutes, preferably for 30 minutes, at this temperature.

The dyeings are finished by cooling the dyebath to 60°–80° C., rinsing them with water and, if desired, effecting a reductive afterclear in alkaline medium in conventional manner. The dyeings are then once more rinsed and dried. When using carriers, the dyeings are conveniently subjected to a heat treatment, e.g. a thremosol treatment, in order to improve the lightfastness. This heat treatment is preferably carried out in the temperature range from 160° to 180° C. over 30 to 90 seconds.

Level and strong dyeings, which in addition are distinguished by good crockfastness and good dye yields, are obtained on synthetic fibre material, especially on linear polyester fibres, by the process of the invention. The other fastness properties of the dyeings, e.g. lightfastness, are scarcely affected by the use of the assistant of the invention.

In the following Preparatory and Application Examples, parts and precentages are by weight.

PREPARATORY EXAMPLE

With cooling, 144.3 g of 3,5,5-trimethylhexyl alcohol and 53.5 g of acrylonitrile are treated dropwise at room temperature over 20 minutes with 2 $cm^3$ of a 30% methanolic potassium hydroxide solution, while keeping the temperature below 40° C. by cooling from time to time. The reaction mixture is stirred for 3 hours at 40° C., then a further 1 $cm^3$ of 30% methanolic potassium hydroxide solution is added and the mixture is kept for a further 2 hours at 40° C. After the reaction mixture has cooled to 25° C., the reaction product is neutralised with acetic acid and kept under vacuum for 60 minutes at 50° C. Yield: 198 g of an adduct of the formula $$(CH_3)_3C-CH_2-\underset{\underset{CH_3}{|}}{CH}-CH_2CH_2-O-CH_2CH_2CN \qquad (14)$$

in the form of a colourless, clear liquid.

The cyanoethylated compounds of the formulae (3) to (13) and (15) to (25) are also prepared in this manner.

The following adducts are examples of components (B) and (C):

ANIONIC COMPONENTS (B)

$B_1$ the ammonium salt of the acid sulfuric acid ester of the adduct of 2 moles of ethylene oxide and 1 mole of alfol (1014);

$B_2$ the ammonium salt of the acid sulfuric acid ester of the adduct of 2 moles of ethylene oxide and 1 mole of stearyl alcohol;

$B_3$ the ammonium salt of the acid sulfuric acid ester of the adduct of 3 moles of ethylene oxide and 1 mole of 2-ethylhexanol;

$B_4$ the ammonium salt of the acid sulfuric acid ester of the adduct of 15 moles of ethylene oxide and 1 mole of stearyl alcohol;

$B_5$ the ammonium salt of the acid sulfuric acid ester of the adduct of 3 moles of ethylene oxide and 1 mole of tridecyl alcohol;

$B_6$ the ammonium salt of the acid sulfuric acid ester of the adduct of 4 moles of ethylene oxide and 1 mole of hydroabietyl alcohol;

$B_7$ the ammonium salt of the acid sulfuric acid ester of the adduct of 3 moles of ethylene oxide and 1 mole of alfol (2022);

$B_8$ the ammonium salt of the acid sulfuric acid ester of the adduct of 3 moles of ethylene oxide and 1 mole of lauryl alcohol;

$B_9$ the di-($\beta$-hydroxyethyl)amine salt of the acid sulfuric acid ester of the adduct of 3 moles of ethylene oxide and 1 mole of lauryl alcohol;

$B_{10}$ the sodium salt of the acid sulfuric acid ester of the adduct of 2 moles of ethylene oxide and 1 mole of lauryl alcohol;

$B_{11}$ the sodium salt of the acid sulfuric acid ester of the adduct of 3 moles of ethylene oxide and 1 mole of lauryl alcohol;

$B_{12}$ the acid phosphoric acid ester of the adduct of 5 moles of ethylene oxide and 1 mole of 2-ethyl-n-hexanol;

$B_{13}$ the ammonium salt of the acid sulfuric acid ester of the adduct of 3 moles of ethylene oxide and 1 mole of butylphenol;

$B_{14}$ the ammonium salt of the acid sulfuric acid ester of the adduct of 5 moles of ethylene oxide and 1 mole of tributylphenol;

$B_{15}$ the ammonium salt of the acid sulfuric acid ester of the adduct of 2 moles of ethylene oxide and 1 mole of nonylphenol;

$B_{16}$ the ammonium salt of the acid sulfuric acid ester of the adduct of 10 moles of propylene oxide and 10 moles of ethylene oxide and 1 mole of nonylphenol;

$B_{17}$ the ammonium salt of the acid sulfuric acid ester of the adduct of 35 moles of ethylene oxide and 1 mole of nonylphenol;

$B_{18}$ the ammonium salt of the acid sulfuric acid ester of the adduct of 50 moles of ethylene oxide and 1 mole of nonylphenol;

$B_{19}$ the ammonium salt of the acid sulfuric acid ester of the adduct of 15 moles of propylene oxide and 1 mole of nonylphenol;

$B_{20}$ the ammonium salt of the acid sulfuric acid ester of the adduct of 6 moles of ethylene oxide and 1 mole of dodecylphenol;

$B_{21}$ the ammonium salt of the acid sulfuric acid ester of the adduct of 6 moles of ethylene oxide and 1 mole of pentadecylphenol;

$B_{22}$ the ammonium salt of the acid sulfuric acid ester of the adduct of 8 moles of ethylene oxide and 1 mole of o-phenylphenol;

$B_{23}$ the sodium salt of the acid maleic acid ester of the adduct of 2 moles of ethylene oxide and 1 mole of p-nonylphenol;

$B_{24}$ the sodium salt of the acid monosulfosuccinic acid ester of the adduct of 2 moles of ethylene oxide and 1 mole of p-nonylphenol;

$B_{25}$ the ammonium salt of the acid phosphoric acid ester of the adduct of 2 moles of ethylene oxide and 1 mole of nonylphenol;

$B_{26}$ the sodium salt of the acid sulfuric acid ester of the adduct of 12 moles of ethylene oxide and 1 mole of dibenzylphenol.

$B_{27}$ the sodium salt of the acid sulfuric acid ester of the adduct of 15 moles of ethylene oxide and 1 mole of dibenzyl-(nonyl)-phenol;

$B_{28}$ the acid phosphoric acid ester of the adduct of 10 moles of ethylene oxide and 1 mole of p-nonylphenol.

NONIONIC COMPONENTS (C)

$C_1$ the polyadduct of 6 moles of ethylene oxide and 1 mole of 2-ethyl-hexanol;

$C_2$ the polyadduct of 5 moles of ethylene oxide and 1 mole of 2-ethylhexanol;

$C_3$ the polyadduct of 15 moles of ethylene oxide and 1 mole of stearyl alcohol;

$C_4$ the polyadduct of 3 moles of ethylene oxide and 1 mole of alfol (8–10);

$C_5$ the polyadduct of 5 moles of ethylene oxide and 1 mole of hexadecyl alcohol;

$C_6$ the polyadduct of 18 moles of ethylene oxide and 1 mole of oleyl alcohol;

$C_7$ the polyadduct of 6 moles of ethylene oxide and 2 moles of butylphenol;

$C_8$ the polyadduct of 4 moles of ethylene oxide and 2 moles of p-cresol;

$C_9$ the polyadduct of 5 moles of ethylene oxide and 1 mole of tributylphenol;

$C_{10}$ the polyadduct of 8 moles of ethylene oxide and 1 mole of p-tert-octylphenol;

$C_{11}$ the polyadduct of 9 moles of ethylene oxide and 1 mole of nonylphenol;

$C_{12}$ the polyadduct of 6 moles of ethylene oxide and 1 mole of nonylphenol;

$C_{13}$ the polyadduct of 10 moles of ethylene oxide and 10 moles of propylene oxide and 1 mole of nonylphenol;

$C_{14}$ the polyadduct of 15 moles of ethylene oxide and 1 mole of oleyl alcohol;

$C_{15}$ the polyadduct of 12 moles of ethylene oxide and 1 mole of oleic acid;

$C_{16}$ the polyadduct of 8 moles of ethylene oxide and 1 mole of o-phenylphenol;

$C_{17}$ the polyadduct of 5 moles of ethylene oxide and 5 moles of propylene oxide with 1 mole of alfol 12–14;

$C_{18}$ the polyadduct of 15 moles of ethylene oxide and 1 mole of castor oil;

$C_{19}$ the polyadduct of 8 moles of propylene oxide and 1 mole of pentaerythritol;

$C_{20}$ the polyadduct of 35 moles of ethylene oxide and 15 moles of propylene oxide with 1 mole of glycerol;

$C_{21}$ the polyadduct of 7 moles of ethylene oxide and 1 mole of $C_9$–$C_{11}$oxo alcohol.

EXAMPLE 1

25 g of a polyethylene glycol terephthalate fabric are treated in a circulation dyeing machine for 5 minutes at 60° C. with a liquor which contains 0.8 g of ammonium sulfate and 0.8 g of an assistant composition (1) comprising 30% of a compound of the formula

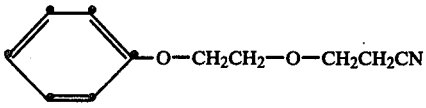

(23)

30% of the phosphoric acid ester of the adduct of 10 moles of ethylene oxide and 1 mole of p-nonylphenol (component $B_{28}$)
10% of the adduct of 8 moles of ethylene oxide and 1 mole of p-tert-octylphenol (component $C_{10}$)
5% of 2-ethyl-n-hexanol
2% of monoethanolamine
2% of a siloxane-oxyalkylene copolymer (A) with a viscosity of 1200 mPas at 20° C. and a cloud point of 32° C., and
20% of water in 400 ml of water, and which is adjusted with 85% formic acid to pH 5.5. To the liquor is then added 0.63 g of a dye of the formula

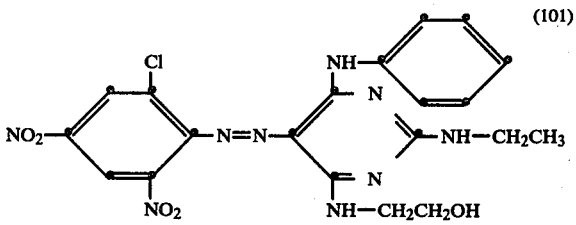

(101)

which is dispersed in a small amount of water. The liquor is then heated to 130° C. over 30 minutes. Dyeing is performed for 20 minutes at this temperature, and the liquor is then cooled to 90° C. The substrate is subsequently rinsed and dried, to give a crock-resistant level, brilliant red dyeing of high colour yield. In addition, no deposits are observed in the interior of the wound package. An intense, crock-resistant red dyeing is also obtained by using, in this Example instead of composition (1), the same amount of the following compositions (2), (3), (4) or (5):

(2) composition comprising
30% of a compound of the formula

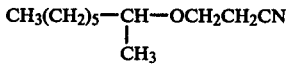

30% of component $B_{28}$
10% of component $C_{10}$
5% of 2-ethyl-n-hexanol
2% of ethanolamine
2% of a siloxane-oxyalkylane copolymer (A) and
21% of water.

(3) Composition consisting of
30% of a compound of the formula

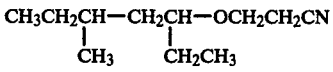

(11)

30% of component $B_{28}$
10% of component $C_{10}$
5% of 2-ethyl-n-hexanol
2% of ethanolamine
2% of a siloxane-oxyalkylene copolymer (A) and
21% of water.

(4) Composition consisting of
30% of a compound of the formula

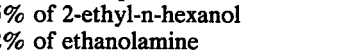

(12)

30% of component $B_{28}$
10% of component $C_{10}$
5% of 2-ethyl-n-hexanol
2% of ethanolamine
2% of a siloxane-oxyalkylene copolymer (A) and
21% of isobutanol.

(5) Composition consisting of
30% of a mixture of the compounds of the formulae

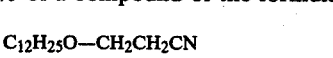

(15)

$R'' = C_{12-20}H_{25-41}$
(40% $C_{12}$, 30% $C_{14}$, 19% $C_{16}$, 10% $C_{18}$, 1% $C_{20}$)

30% of component $B_{28}$
10% of component $C_{10}$
5% of 2-ethyl-n-hexanol
2% of ethanolamine
2% of a siloxane-oxyalkylene copolymer (A) and
21% of isobutanol.

EXAMPLE 2

A 400 g wound package of polyethylene glycol terephthalate fibres is treated for 10 minutes at 60° C. in a circulating dyeing machine with a liquor which contains 16 g of ammonium sulfate and 16 g of the assistant composition (3) in 8 liters of water, and which is adjusted with 85% formic acid to pH 5.5. To the liquor is then added 1 g of a dyestuff mixture consisting of 0.4 g of a dye of the formula

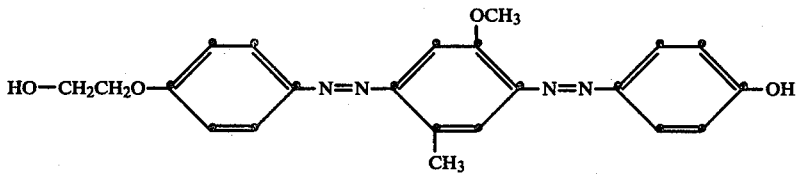

(102)

0.2 g of a dye of the formula

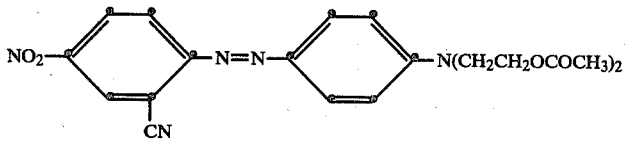

(103)

and 0.4 g of a dye of the formula

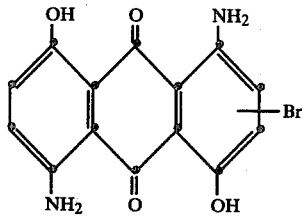

(104)

and the dyebath is subsequently heated over 30 minutes to 130° C. Dyeing is performed for 30 minutes at this temperature, then the bath is cooled to 90° C. The goods are rinsed and dried, to give a grey dyeing of good fastness properties.

EXAMPLE 3

10 g of polyethylene glycol terephthalate knitted fabric which has been previously HT dyed with a dyestuff mixture consisting of 2.9 g of a dye of the formula

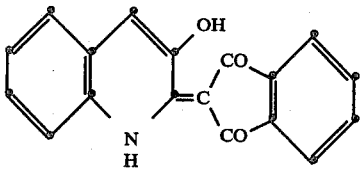

(105)

2.6 g of a dye of the formula

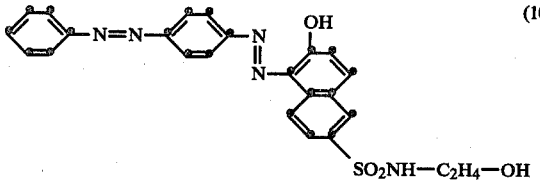

(106)

and 0.8 g of the dye of the formula (104), are wound on a perforated drum. Then 10 g of the same undyed fabric are wound and put into the drum. This substrate is then put into 200 ml of a liquor of 60° C. which contains 0.4 g of the dyeing assistant (5) and 0.4 g of ammonium sulfate, and the pH of which has been adjusted with 85% formic acid to 5.5. The liquor is then heated over 30 minutes to 130° C. and the substrate is treated for 60 minutes at this temperature. The liquor is then cooled and the substrate is rinsed and dried. A deep dyeing of excellent levelness is obtained on the previously undyed substrate.

EXAMPLE 4

100 kg of polyester fabric are prewetted at 60° C. in 3500 liters of water in a winch beck. The following ingredients are then added:

6000 g of ammonium sulfate
4000 g of a disperse dye of the formula (106) and
3000 g of an assistant composition consisting of
35% of a compound of the formula

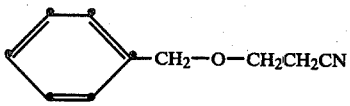

(22)

20% of component $B_{12}$
10% of the adduct of 7 moles of ethylene oxide and 1 mole of $C_9$–$C_{11}$oxo alcohol (component $C_{21}$)
5% of trimethylhexanol
1% of the siloxane-oxyalkylene copolymer (A), and
29% of water.

The dye liquor is then adjusted to pH 5.5 with formic acid and heated to 125° C. over 30 minutes. The goods are then dyed for 30 minutes at this temperature and subsequently rinsed and dried. An intense, crock-resistant red dyeing is obtained.

Using the same procedure, but without the addition of the assistant composition (6), the dyeing is 15% weaker.

An intense and crock-fast red dyeing is obtained also by using in this Example, instead of the assistant composition (6), the same amount of dyeing assistant (1) or of the following compositions (7) or (8):

(7) Composition consisting of
25% of a compound of the formula

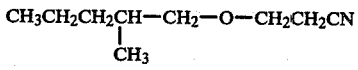

(6)

20% of the monoethanolamine salt of dodecylbenzenesulfonic acid
20% of the adduct of 9 moles of ethylene oxide and 1 mole of nonyl phenol (component $C_{11}$)
5% of isobutanol and
30% of water.

(8) Composition consisting of
35% of a compound of the formula (19)
20% of dioctyl sulfosuccinate
10% of component $B_{15}$
10% of component $C_{18}$
3% of the siloxane-oxyalkylene copolymer (A) and
22% of water.

EXAMPLE 5

100 kg of a non-prescoured fabric having a residual fat content of 3.15% and consisting of 50% cotton and 50% polyester are treated for 20 minutes at 40° C. in a HT winch beck with an aqueous liquor (3000 liters) which contains 54 g of a dye of the formula (103)
27 g of a dye of the formula (107)

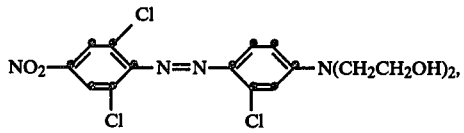

130 g of a dye of the formula (108)

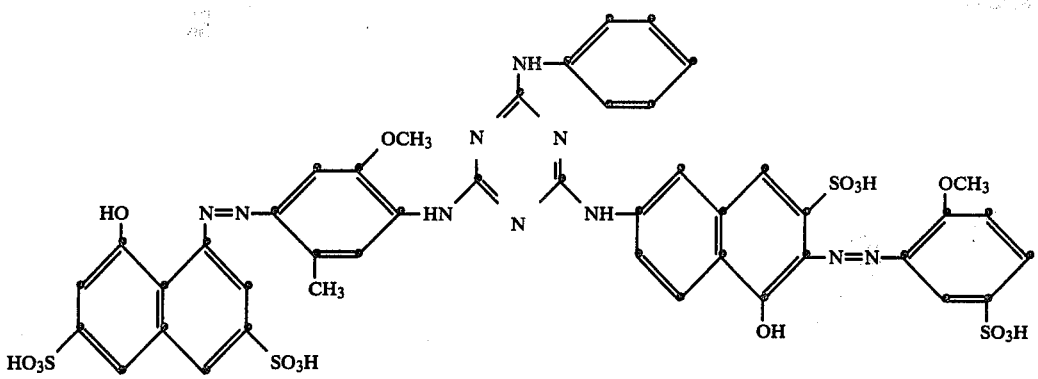

10 g of a dye of the formula (109)

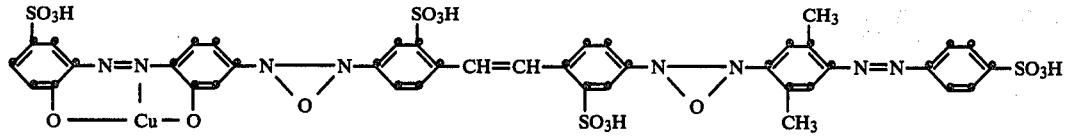

5000 g of the dyeing assistant (7) of Example 4 and
6000 g of ammonium sulfate, and has a pH of 5.6. Then 10 kg of calcined Glauber's salt are added and the bath is heated to 115° C. over 40 minutes. Dyeing is carried out for 30 minutes at this temperature and the bath is then cooled. The goods are subsequently rinsed and dried. An intense, level beige dyeing is obtained, and the residual fat content is only 0.65%.

EXAMPLE 6

10 g of polyethylene glycol terephthalate fabric are treated for 5 minutes at 40° C. in a dyeing machine in a liquor which contains 0.2 g of composition (1) and
0.01 g of a fluorescent whitening agent of the formula (110)

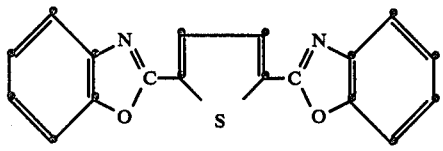

which is dispersed in 200 ml of water. The bath has been adjusted to pH 5.5 with 85% formic acid. The bath is then heated to 110° C. over 30 minutes and the goods are treated for 30 minutes at this temperature. The bath is then cooled and the goods are subsequently rinsed and dried at 70° C. A level, brilliant white effect with an excellent degree of whiteness is obtained.

EXAMPLE 7

The procedure of Example 6 is repeated, but using a treatment liquor which, instead of containing the fluorescent whitening agent of the formula (110), contains the same amount of a fluorescent whitening agent of the formula (111)

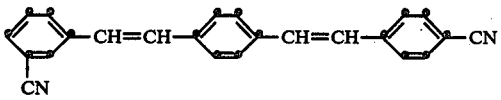

or of the formula (112)

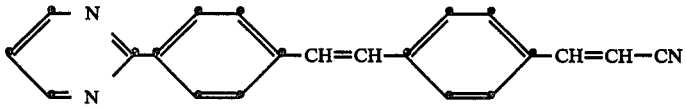

Level brilliant white effect are likewise obtained.

What is claimed is:

1. A dyeing assistant which comprises at least
(A) an O-cyanoethylated compound of the formula $$R(O—CH_2CH_2CN)_n, \quad (1)$$

wherein R is an n-valent aliphatic, cycloaliphatic or araliphatic radical, and n is 1 to 5,
(B) an anionic surfactant, and
(C) an non-ionic surfactant.

2. An assistant according to claim 1, which comprises additionally, as component (D), an aliphatic alcohol containing 5 to 18 carbon atoms, a siloxane-oxyalkylene copolymer, or a mixture thereof.

3. An assistant according to claim 1, which comprises additionally as component (E) a polar solvent.

4. An assistant according to claim 1, which comprises additionally, as component (D), an aliphatic alcohol containing 5 to 18 carbon atoms, a siloxane-oxyalkylene copolymer, or a mixture thereof and, as component (E), a polar solvent.

5. An assistant according to claim 1, wherein component (A) is an O-cyanoethylated compound of the formula $$R_1—O—CH_2CH_2CN \quad (2)$$

wherein $R_1$ is an aliphatic radical of 3 to 22 carbon atoms or a phenoxyethyl radical which is unsubstituted or substituted by halogen, lower alkyl or lower alkoxy.

6. An assistant according to claim 5, wherein $R_1$ in formula (2) is alkyl of 3 to 22 carbon atoms.

7. An assistant according to claim 1, wherein component (B) is an anionic surfactant of the formula $$Y—O—(CH_2CH_2O)_mX \quad (26)$$

wherein Y is alkyl or alkenyl, each of 8 to 22 carbon atoms, alkylphenyl containing 4 to 16 carbon atoms in the alkyl moiety, or o-phenylphenyl, X is the acid radical of an inorganic oxygen-containing acid or of an organic acid, and m is 2 to 40.

8. An assistant according to claim 7, wherein component (B) is an anionic surfactant of the formula

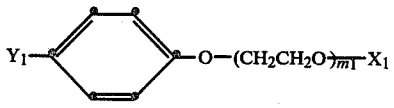

(27)

wherein $Y_1$ is octyl or nonyl, $m_1$ is 2 to 15, and $X_1$ is a radical derived from sulfuric acid or o-phosphoric acid, said surfactant being in the form of the free acid or of the sodium or ammonium salt.

9. An assistant according to claim 1, wherein component (C) is a non-ionic adduct of 100 moles of alkylene oxide and 1 mole of an aliphatic monoalcohol containing at least 4 carbon atoms, of a trihydric to hexahydric aliphatic alcohol, of an unsubstituted or alkyl- or phenyl-substituted phenol, or of a fatty acid containing 8 to 22 carbon atoms.

10. An assistant according to claim 9, wherein component (C) is an adduct of 2 to 15 moles of ethylene oxide and 1 mole of a fatty alcohol or fatty acid, each containing 8 to 22 carbon atoms, or 1 mole of an alkylphenol containing altogether 4 to 12 carbon atoms in the alkyl moiety, or is a fatty acid dialkanolamide containing 8 to 22 carbon atoms in the fatty acid moiety.

11. An assistant according to claim 1, which comprises at least (Aa) an O-cyanoethylated compound of the formula $$R_2—O—CH_2CH_2CN, \quad (28)$$

wherein $R_2$ is an aliphatic radical of 6 to 22 carbon atoms or a phenoxyethyl radical which is unsubstituted or substituted by halogen, methyl or methoxy, (Bb) a phosphoric acid ester, or a salt of such an ester, of a polyadduct of 2 to 20 moles of ethylene oxide with 1 mole of a fatty alcohol containing 8 to 18 carbon atoms, or with 1 mole of a p-alkylphenol containing 4 to 16 carbon atoms in the alkyl moiety, or a mixture of these acid esters, and (Cc) an adduct of 2 to 15 moles of ethylene oxide with 1 mole of a fatty alcohol or fatty acid, each containing 8 to 22 carbon atoms, or with 1 mole of an alkylphenol containing altogether 4 to 12 carbon atoms in the alkyl moiety.

12. An assistant according to claim 2, wherein component (D) is an alkanol containing 5 to 10 carbon atoms.

13. An assistant according to claim 2, wherein component (D) is a polyether siloxane having a cloud point of 20° to 70° C.

14. An assistant according to claim 3, wherein component (E) is water or isobutanol.

15. An assistant according to claim 1, which comprises 10 to 80% by weight of component (A)
10 to 50% by weight of component (B)
5 to 25% by weight of component (C)
0 to 15% by weight of component (D), and
0 to 40% by weight of component (E), based on the entire composition.

16. An assistant according to claim 15, wherein component (D) is present in an amount of 2 to 10% by weight, based on the weight of the mixture.

17. An assistant according to claim 15, wherein component (E) is present in an amount of 10 to 35% by weight, based on the weight of the mixture.

18. A process for dyeing synthetic fibre material with cationic or disperse dyes or for whitening such material with fluorescent whitening agents, which process comprises dyeing or whitening said material in the presence of an assistant composition which contains at least (A) an O-cyanoethylated compound of the formula $$R(O—CH_2CH_2CN)_n, \quad (1)$$

wherein R is an n-valent aliphatic, cycloaliphatic or araliphatic radical, and n is 1 to 5, (B) an anionic surfactant, and (C) a non-ionic surfactant.

19. A process according to claim 18, wherein the assistant composition additionally contains, as component (D), an aliphatic alcohol containing 5 to 18 carbon atoms, a siloxane-oxyalkylene copolymer, or a mixture thereof, and, as component (E), a polar solvent.

20. A process according to claim 18, wherein the fibre material is dyed with disperse dyes.

21. A process according to claim 18, wherein the assistant composition is used in an amount of 0.5 to 6% by weight, based on the weight of the goods.

22. A process according to claim 18, wherein dyeing or whitening is carried out in the temperature range from 80° to 135° C.

23. A process according to claim 22, wherein the temperature range is from 110° to 135° C.

* * * * *